US005954494A

United States Patent [19]

Goldsmith et al.

[11] Patent Number: 5,954,494

[45] Date of Patent: Sep. 21, 1999

[54] PRESSURE WASHER BLOWER IGNITION ELECTRICAL SYSTEM

[75] Inventors: Thomas L. Goldsmith, Earlville; Ricky L. Weires, Maquoketa; Michael J. Wuertzer, Centralia, all of Iowa

[73] Assignee: MI-T-M Corporation, Peosta, Iowa

[21] Appl. No.: 08/881,999

[22] Filed: Jul. 25, 1997

Related U.S. Application Data

[63] Continuation of application No. 08/628,771, Jul. 28, 1995, abandoned, which is a continuation of application No. 08/109,295, Aug. 19, 1993, abandoned.

[51] Int. Cl.[6] ..... F23Q 7/12

[52] U.S. Cl. ..... 431/254; 431/255

[58] Field of Search ..... 431/254, 255

[56] References Cited

U.S. PATENT DOCUMENTS

D. 273,431 4/1984 Linton .
D. 288,017 1/1987 Linton .
D. 303,854 10/1989 Linton .
D. 314,648 2/1991 Linton .

OTHER PUBLICATIONS

Landa America's Largest manufacturer of Pressure Washers "MG" flyer.
General Pump Incorporated "Ypresswitch Pressure Switch" flyer.
Aries Supply and Equipment "The Clean Team" flyer.
Alkota Cleaning Systems, Inc. "Solving Cleaning Problems" flyer.
Karcher "HDS 1200 BE" flyer.
Jenny Division Hornstead Industries, Inc. "Jenny's Mule Specifications and Descriptions" flyer.
SW Series flyer.
Farley's Inc. "Patriot Series" flyer.
EX–Cell Manufacturing Co., Inc. "Super Skid" flyer.
Delco Clarke Industries, Inc. "The Equalizer Advantages . . . " flyer.
A–M–C– Incorporated "Power Blaster" flyer.
Portotecnica USA "Hand–Carried Electric, Cold Water" flyer.
SIRIO SRL "High–Pressure Washers" flyer.
Scorpion Hot Water Cleaners flyer.
Specialty Equipment Company "Futura" flyer.
Simpson Cleaning Systems, Inc. "Water Shotgun" flyer.
Northeast Industries "Firehawk Series" flyer.
Hydro Engineering Incorporated "The Hydroblaster Portable–Gasoline Driven!" flyer.
Hydro Engineering Incorporated "The Hydroblaster Skid Mounded!" flyer.
The Kent Company "Models:KW–1015H Pressure Washer" flyer.

*Primary Examiner*—A. Michael Chambers
*Attorney, Agent, or Firm*—Henderson & Sturm

[57] ABSTRACT

The blower/ignition/electrical system supplies the air, spark, and electrical power to facilitate and control the fuel combustion in a heat exchanger for devices which output a fluid, such as a pressure washer. The system is belt driven as an intricate part of the mechanical power system used for the fluid pressure pump. The flange/magnet hub spins past the ignition coil which in turn produces a high voltage electrical source. This potential is applied across the electrode gap to ignite a fuel. The flange magnet hub also spins past a stator coil assembly which in turn produces an alternating current. This current can be rectified or left unrectified, and is wired to a switch. When the switch is activated, the current path is through the safety control devices (such as temperature control, pressure switch or flow switch) and the fuel solenoid valve which controls the fuel flow into the combustion chamber. With the air, ignition spark, and fuel supplied and controlled in the combustion chamber, fuel combustion can now occur.

20 Claims, 6 Drawing Sheets

PRESSURE WASHER BLOWER IGNITION ELECTRICAL SYSTEM

This application is a file wrapper continuation of U.S. patent application Ser. No. 08/628,771, filed Jul. 28, 1995, now abandoned, which was a file wrapper continuation of U.S. patent application Ser. No. 08/109,295, filed Aug. 19, 1993, now abandoned.

TECHNICAL FIELD

This invention relates to apparatus, such as pressure washers, which output heated fluids. More specifically, this invention relates to facilitating and controlling fuel combustion in a heat exchanger for devices which output fluids.

BACKGROUND ART

Devices which output fluids include pressure washers used to clean equipment, buildings, automobiles and other items. Other devices of this type may include portable water or chemical heaters. These devices producing an output of fluids may be powered by an internal combustion engine, electric motor, or some other means of mechanical power. To provide the heating of the fluid, these devices typically employ a burner assembly with its own mechanical power source. Many have other means of supplying air, spark, and fuel to the combustion chamber; however, they still require an outside electrical power source and ignition transformer. The outside electrical power source usually means an alternating current from an electrical outlet or generator, or direct current from a battery system.

DISCLOSURE OF INVENTION

A blower/ignition/electrical system is disclosed for a device with a heat exchanger that outputs fluids. The broad concept of this invention is to provide the necessary components for combustion (air, spark, and fuel) without a burner assembly that has its own mechanical power source and without an outside electrical power source. Air is provided by the spinning of the blower wheel inside the blower housing. The ignition is provided by the high voltage electrical source produced in the ignition coil, induced by the magnetic field of the spinning magnets. The electrodes facilitate a spark across their gap. The fuel is provided by a fuel pump that pressurizes fuel to the solenoid valve. The solenoid valve controls the fuel flow to the fuel nozzle in the combustion chamber. The solenoid is powered by the electrical power source from the alternator stator coil in the blower/ignition/electrical system.

A main switch is placed in the circuit between the electrical power source and solenoid to facilitate activating the combustion control when desired. Safety control devices, such as a temperature control, flow switch, or pressure switch, may be included in the electrical circuit to control the solenoid valve and hence control the fuel flow to the combustion chamber after the main switch has been activated. For example, a pressure switch may be installed on a pressure washer to sense the fluid pressure of the system, and is wired into the control circuit. It may be arranged so that when the trigger valve on the unit is released and the fluid pump goes into bypass, the pressure switch opens the circuit, and the solenoid valve closes. This shuts off the flow of fuel to the nozzle in the combustion chamber, and combustion will cease.

This blower/ignition/electrical system is self contained in that no outside electrical power source is needed. The only requirement is a means of transmitting mechanical power to spin the flange/magnet hub assembly. This comes from the same means of power transmission as the fluid pump, thus not requiring an additional mechanical power source.

It is a feature and advantage of this invention to eliminate the external power source or generator for the fuel solenoid and controls.

It is also a feature of this invention to provide all the necessary components of combustion (air, spark and fuel) without an additional mechanical power source (i.e. electric motor on burner assembly).

It is yet another feature and advantage of this invention to provide means for combustion in heat exchangers regardless of the mechanical power source (i.e. gasoline engine, diesel engine, electric motor, etc.).

Another feature of this invention is to facilitate supplying power for auxiliary lighting, safety control devices that regulate the flow of electricity (such as a primary control/cad cell), or other electrical devices.

These objects and other features and advantages of this invention will become apparent to those skilled in the art readily upon referring to the following description in conjunction with the appended drawings.

BRIEF DESCRIPTION OF THE DRAWINGS

The pressure washer blower ignition electrical system is illustrated in the drawings wherein.

DETAILED DESCRIPTION OF A PREFERRED EMBODIMENT OF THE INVENTION

Figure 1:
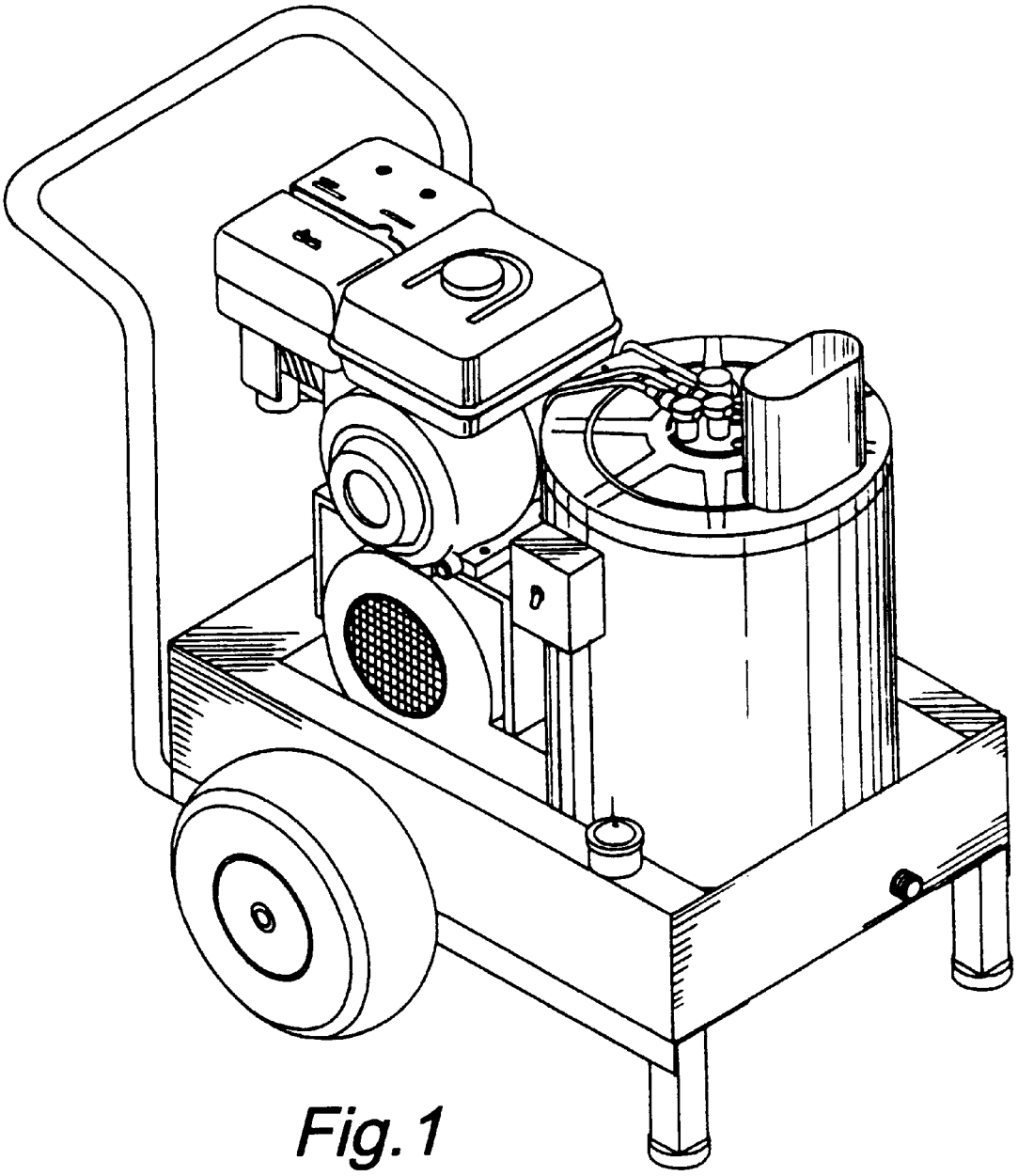
FIG. 1 is a perspective view of a pressure washer.
Figure 2:
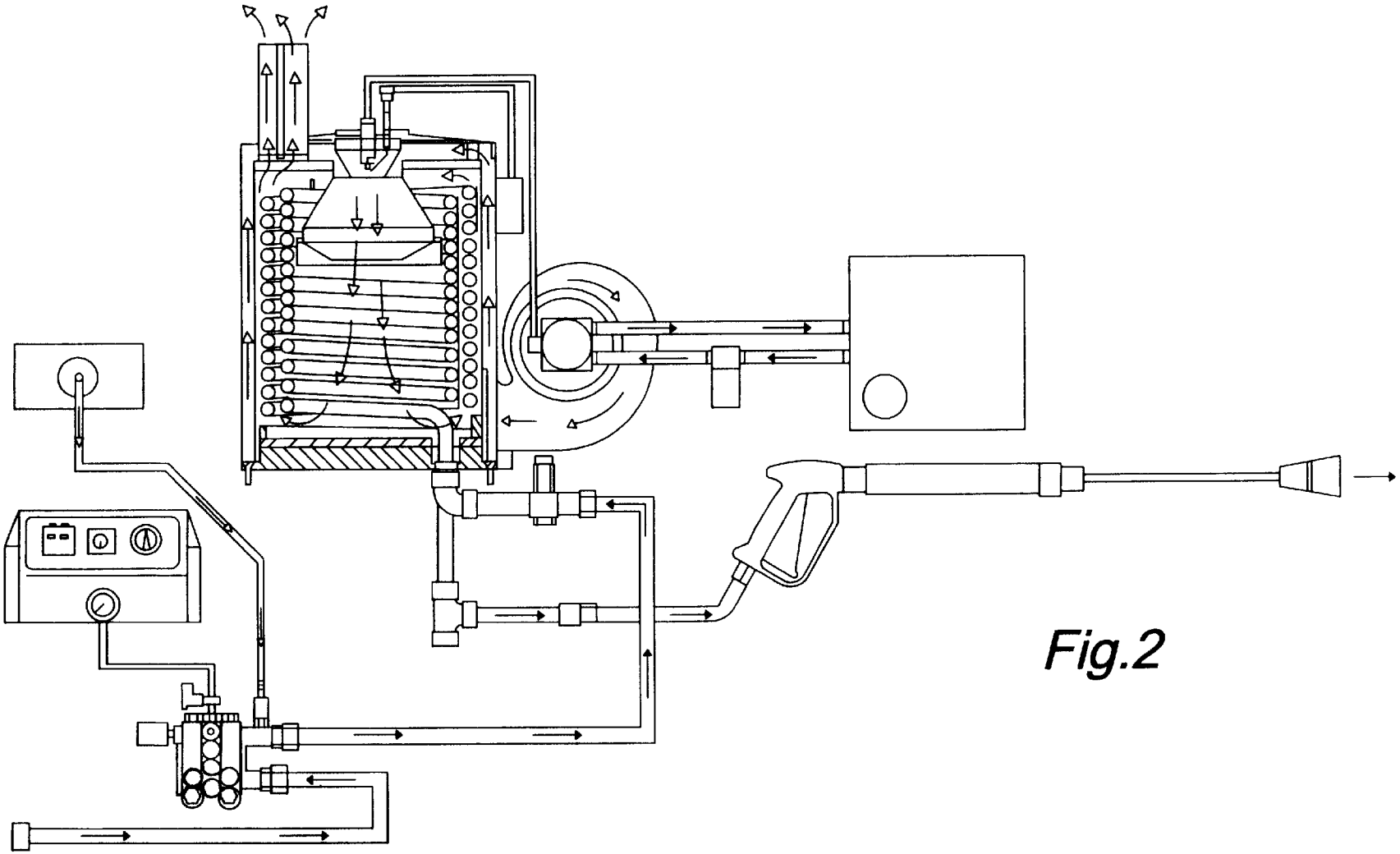
FIG. 2 is a schematic diagram of pressure washer components showing water flow.
Figure 3:
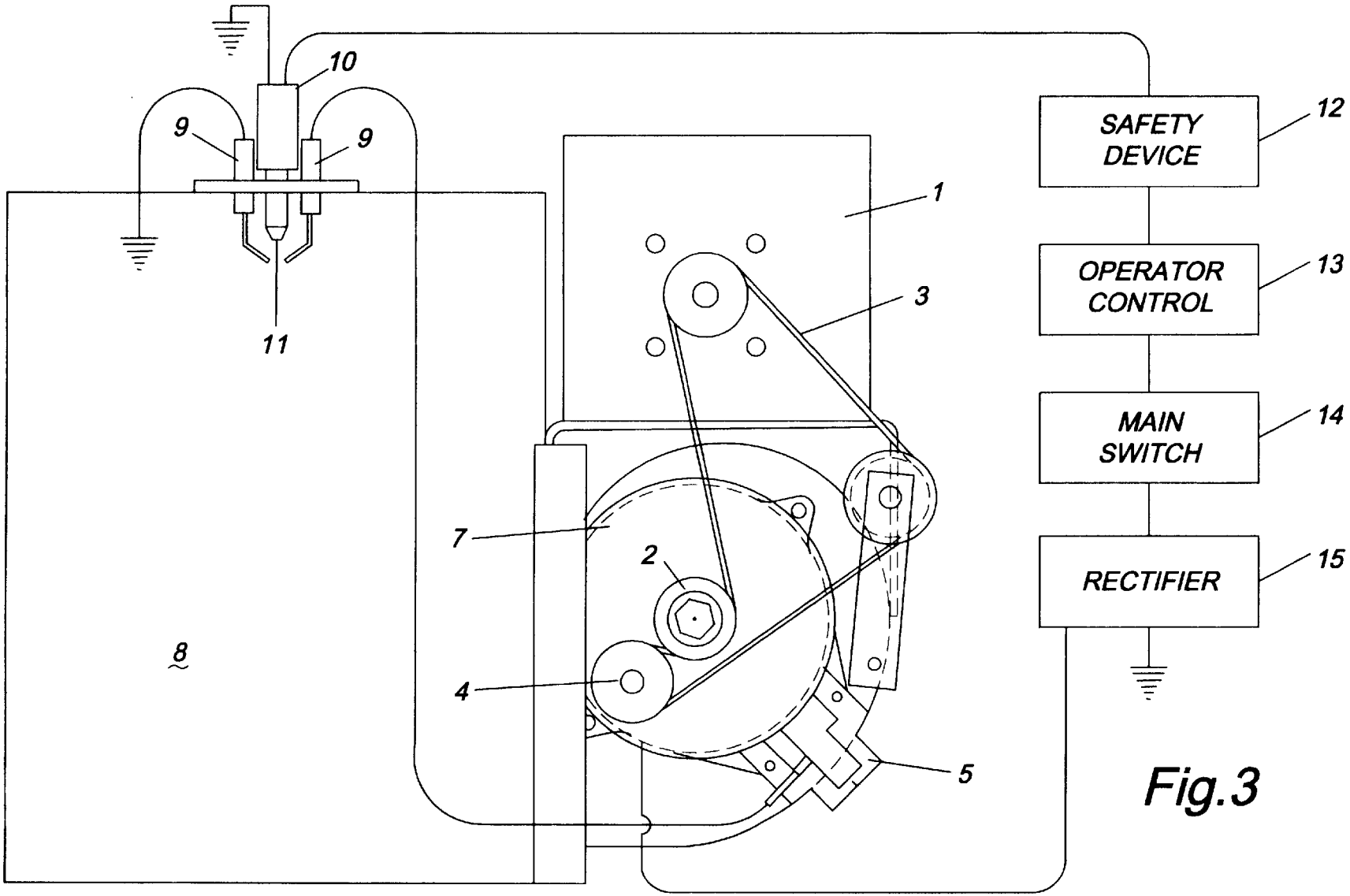
FIG. 3 is a schematic, side elevational view showing blower ignition electrical system components.

A device with a heat exchanger that outputs a pressurized fluid, such as a pressure washer, and incorporates the blower/ignition/electrical system according to this invention, is shown generally in FIG. 1. Referring to FIG. 3, the mechanical power source 1 provides the power transmitted to the flange/magnet hub 2 via belt 3. Belt 3 also transmits power to the fuel pump 4 which pressurizes fuel to the fuel solenoid valve 10. With the flange/magnet hub 2 operating, ignition coil 5 produces the high voltage electrical power which arcs across electrodes 9 for igniting the fuel from the nozzle 11. Also with the flange/magnet hub 2 operating, stator coil 6 produces an electrical power who's path can be through a rectifier 15, main switch 14, operational control 13, and safety control device 12 to power the fuel solenoid valve 10. When energized, this solenoid valve allows the fuel to flow to the fuel nozzle 11.

Air is forced into the combustion chamber 8 by the blower wheel 7 which is coupled to a shaft that is coupled to a shaft that is coupled to the flange/magnet hub 2. With the air provided by the blower wheel 7, spark provided by the ignition coil 5, and fuel controlled by the solenoid valve 10, combustion is facilitated. The heat exchanger 8 can now heat the fluids.

Figure 4:
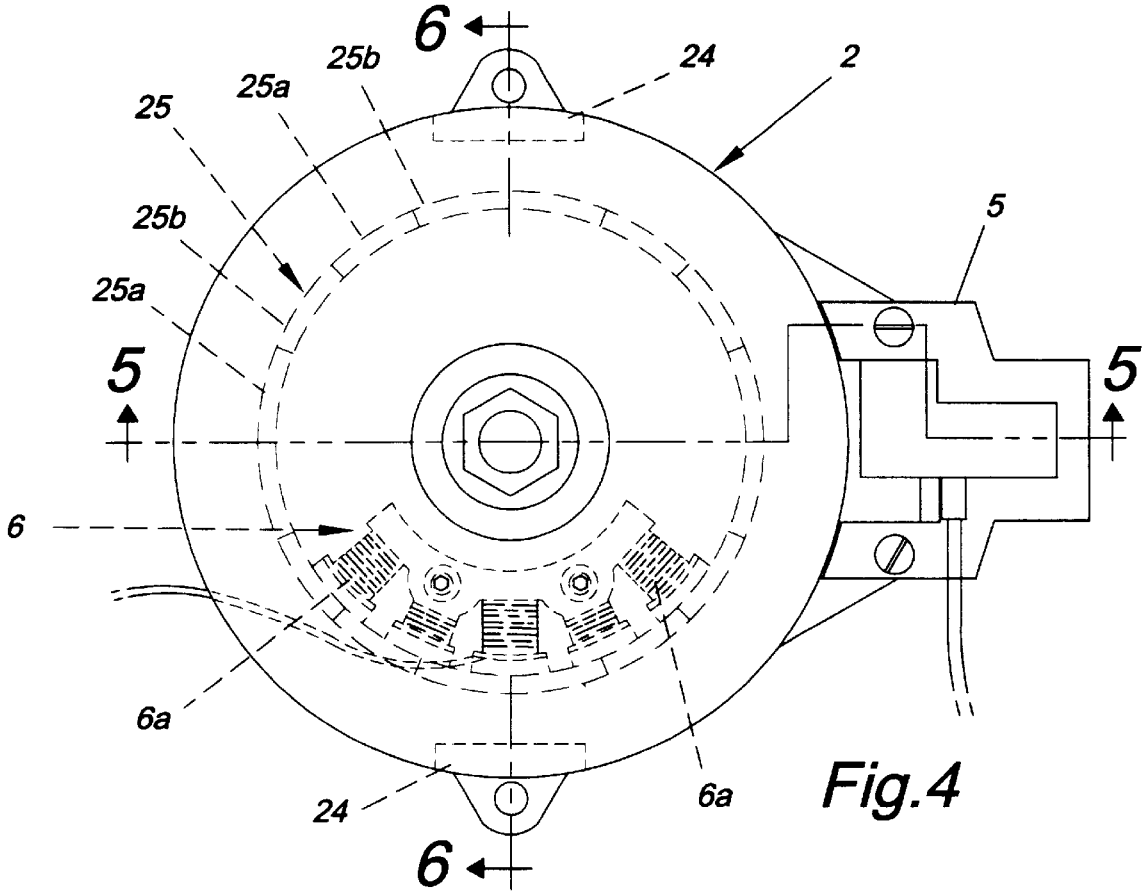
FIG. 4 is an enlarged, side elevational view of the flange/magnet hub assembly.
Figure 5:
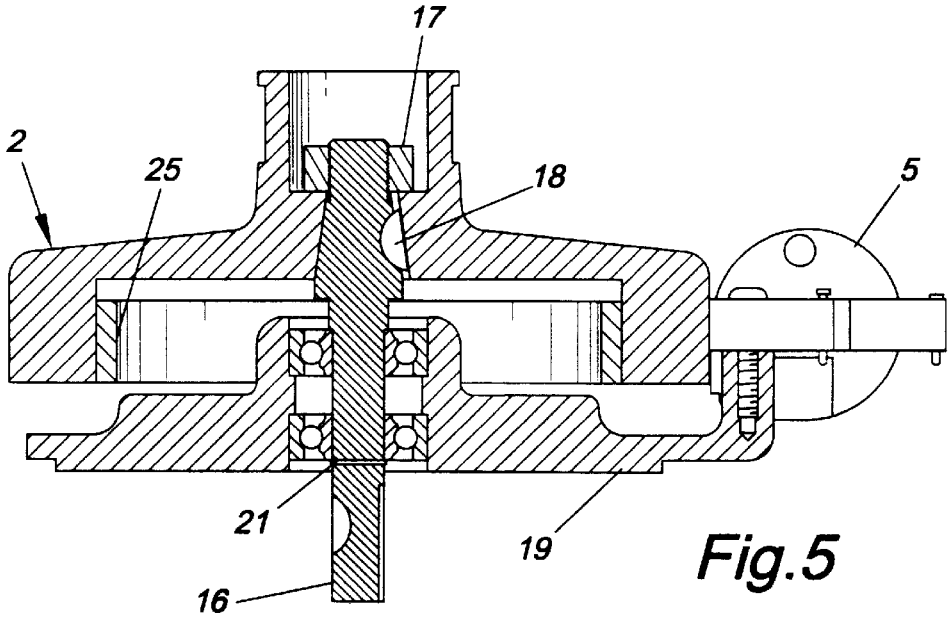
FIG. 5 is a horizontal sectional view taken along line 5—5 of FIG. 4.
Figure 6:
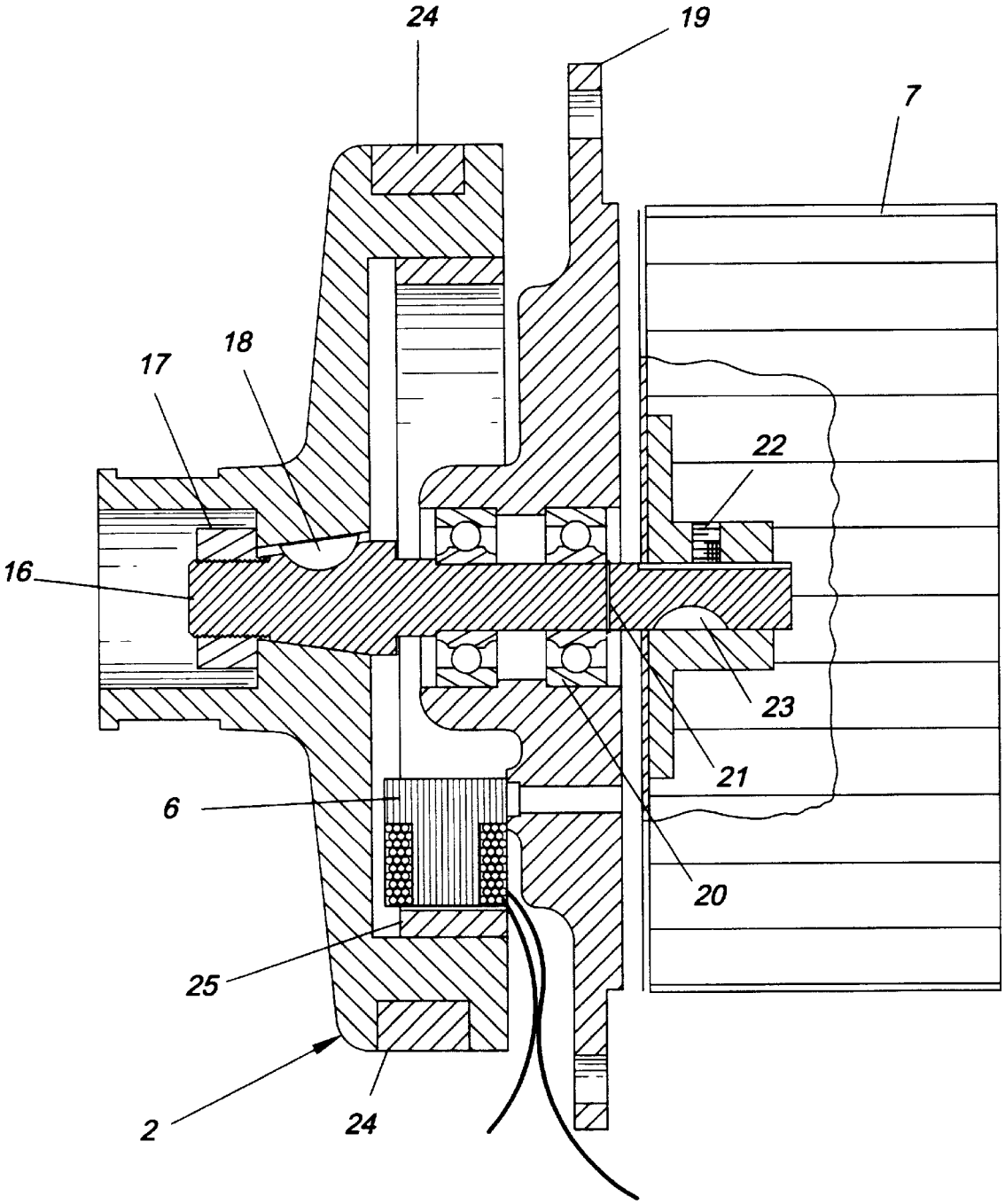
FIG. 6 is an enlarged, vertical sectional view taken along line 6—6 of FIG. 4.

FIGS. 4–6 are views of the blower/ignition/electrical system assembly. In FIGS. 4–6, as in all figures, corresponding components have been given the same numerical designations. FIGS. 4–6 more clearly depict the interconnection of the components which make up the assembly for the blower/ignition/electrical system.

The flange/magnet hub 2 is coupled to the shaft 16 by a hex nut 17 and woodruff key 18. Flange 19 retains the shaft bearings 20 and the shaft is retained in place by a snap ring 21. Flange 19 also provides the means of mounting the whole assembly to the blower housing of the heat exchanger 8 (FIG. 3). A pair of ignition magnets 24 provide the magnetic field for the ignition coil 5. The alternator magnet 25 provides the magnetic field for the stator coil 6. The alternator magnet 25 is annular shaped and fits within the flange/magnet hub 2. The magnet 25 has been so magnetized as to have a plurality of magnetized areas 25*a*, 25*b* of alternating polarities. The stator coil 6 may be a plurality of coils 6*a* coupled together and disposed from part way to entirely about the circumference of the flange/magnet hub 2. Blower wheel 7 is coupled to the shaft 16 by means of a collar set screw 22 and woodruff key 23.

Figure 7:
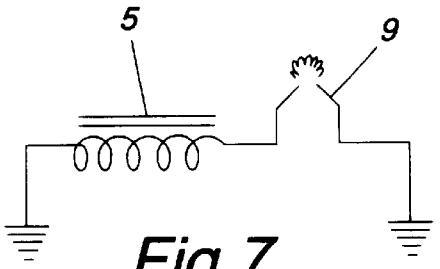
FIG. 7 is a schematic of the preferred ignition circuit.

FIG. 7 is a schematic diagram depicting the ignition circuit of the blower/ignition/electrical system. In FIG. 7 through magnetic flux, the ignition coil 5 provides a high voltage electrical power that arcs across the electrodes 9.

Figure 8:
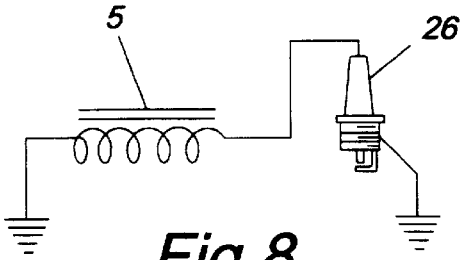
FIG. 8 is a schematic of an alternate ignition circuit.

The circuit in FIG. 8 is similar to the circuit in FIG. 7 except the electrodes 6 are replaced by a spark plug 26.

Figure 9:
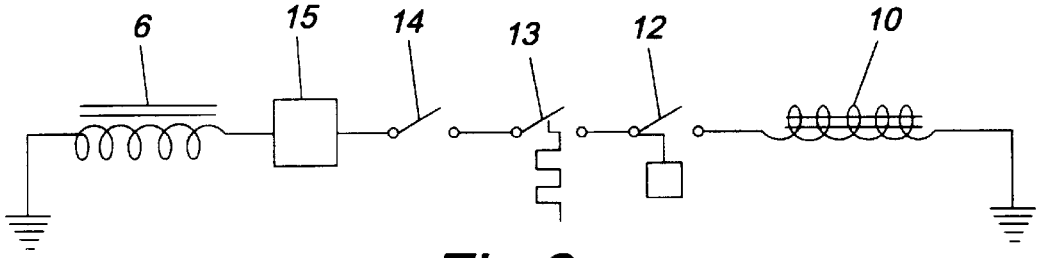
FIG. 9 is a schematic of the preferred switch circuit.

FIG. 9 is a schematic diagram depicting the electrical circuit of the blower/ignition/electrical system. In FIG. 9 the stator coil 6 generates an alternating current signal that can be rectified by a rectifier 15. The electrical path is to a main switch 14. When switch 14 is closed, the current path is to a temperature control switch 13 and fluid sensing (either pressure or flow) switch 12 to energize the electromagnetic solenoid valve 10.

Figure 10:
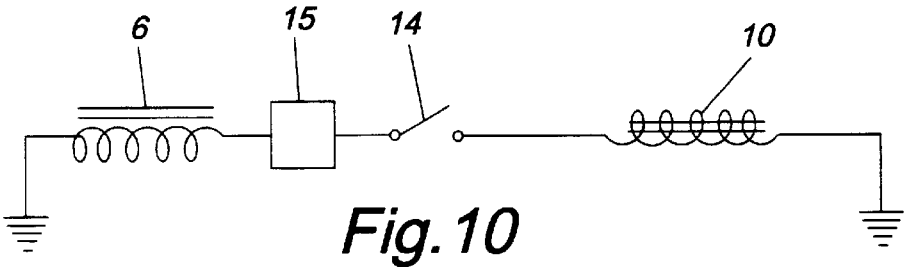
FIG. 10 is a schematic of an alternate switch circuit.

The circuit in FIG. 10 is similar to the circuit in FIG. 9 except the safety control devices have been removed to save cost. This is a workable configuration; however, it is not recommended because of safety factors.

Figure 11:
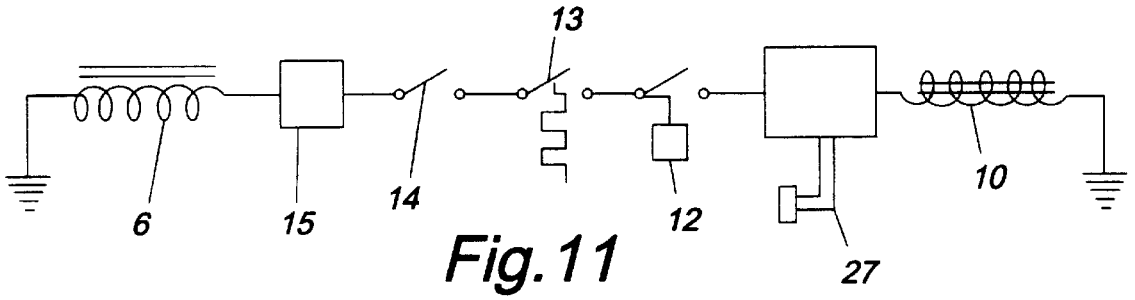
FIG. 11 is a schematic of another alternate switch circuit.

The circuit in FIG. 11 is similar to the circuit in FIG. 9 except it shows an additional safety control device 27, such as a primary control/cad cell, incorporated into the circuit.

The industrial applicability of this pressure washer blower ignition electrical system invention is believed to be apparent from the foregoing description. Although a preferred embodiment and modifications thereof have been disclosed herein, it is to be remembered that various alternate constructions can be made thereto without departing from the scope of this invention.

We claim:

1. A pressure washer, comprising:

(a) an internal combustion engine;

(b) a heat exchanger;

(c) an igniter for igniting fuel in said heat exchanger;

(d) a fuel control valve for controlling fuel flow to said heat exchanger; and (e) a dual magneto comprising:

a first magneto having a first set of magnets and an ignition coil, said first magneto operably driven by said internal combustion engine for providing an electrical ignition source to said igniter; and a second magneto having a second set of magnets and a stator, said second magneto operably driven by said internal combustion engine for providing an electrical power source for operating said fuel control valve.

2. The pressure washer as recited in claim 1 wherein said first and second magnetos are secured within a singular hub, said hub operably driven by said internal combustion engine.

3. The pressure washer as recited in claim 2 further comprising a blower secured to said singular hub.

4. The pressure washer as recited in claim 3 further comprising an over-temperature shutoff switch for said fuel control valve.

5. The pressure washer as recited in claim 3 further comprising an over-pressure shutoff switch for said fuel control valve.

6. The pressure washer as recited in claim 3 further comprising a water low-pressure shutoff switch for said fuel control valve.

7. The pressure washer as recited in claim 3 further comprising an low-flow shutoff switch for said fuel control valve.

8. The pressure washer as recited in claim 3 further comprising a primary control/cad cell for said fuel control valve.

9. A compact self contained pressure washer unit comprising:

a liquid supply for use in said pressure washer;

a liquid pump for pressurizing said liquid;

a heat exchanger wherein fuel is burned to heat said liquid;

an internal combustion engine having a flywheel magneto system, said flywheel magneto system powering said liquid pump;

a hub assembly coupled to said internal combustion engine;

a blower for forcing air into and through said heat exchanger;

a fuel pump;

a shaft secured to said hub assembly, said shaft further operably coupling said blower and said fuel pump such that said blower, said fuel pump and said hub assembly are in coaxial alignment;

a fuel solenoid valve which controls fuel flow to a fuel nozzle disposed in said heat exchanger;

spaced electrodes disposed near said fuel nozzle for providing an electrical arc gap to ignite said fuel flowing through said fuel nozzle past said arc gap; and an electro-magnetic firing system generated by said hub assembly that provides a first high voltage electrical current to said spaced electrodes, and a second electrical current to operate said fuel solenoid valve.

10. The compact self contained pressure washer unit of claim 9 wherein said hub assembly includes:

a rotatable, non-magnetic, hub-shaped, annular wheel having an exterior periphery and an interior periphery, said hub-shaped wheel including two fixed exterior magnets disposed in said outer periphery, said hub-shaped wheel further including a fixed annular magnet disposed within said interior periphery, said annular magnet having a plurality of magnetized areas of alternating polarities;

a stationary ignition coil disposed adjacent to and in close proximity to said outer periphery of said rotatable, hub-shaped, annular wheel; and stator coils disposed within said interior periphery of said hub-shaped, annular wheel and in close proximity to said internally mounted annular magnet;

whereby, a first high voltage electrical current is produced by said ignition coil as said exterior magnets fixed in said exterior periphery of said hub-shaped annular wheel rotates past said ignition coil, said first high voltage electrical current providing the ignition source for igniting fuel in said heat exchanger as said voltage arcs across the electrodes thereby giving the spark that is needed for ignition, and further whereby a second electrical current is produced by said stator as said annular magnet revolves around said stator, said second electrical current providing the necessary voltage to operate a fuel solenoid valve that controls the fuel supply to said heat exchanger.

11. In a hot water pressure washer having an internal combustion engine and a heat exchanger, a blower-ignition-electrical system comprising:

a shaft;

a flywheel mounted on said shaft and coupled to the internal combustion engine;

a flange, said shaft mounted through said flange; a first magneto powered by said flywheel and providing an electrical ignition source to an igniter in said heat exchanger;

a second magneto powered by said flywheel and providing an electrical power source for operating a fuel control valve;

said first and second magneto both mounted on said flywheel and flange;

a blower, secured to said shaft;

a fuel pump secured to said shaft; and said flywheel, flange, blower and fuel pump being coaxial with said shaft.

12. The apparatus as recited in claim 11, further comprising an electronic fuel control coupled to said electrical power source.

13. The apparatus as recited in claim 12, wherein said first magneto comprises a first permanent magnet and an ignition coil, and said second magneto comprises a second permanent magnet and a stator.

14. The apparatus as recited in claim 13, wherein said first permanent magnet and said second permanent magnet are carried by said flywheel.

15. The apparatus as recited in claim 13, wherein said ignition coil and said stator are fixed to said flange.

16. The apparatus as recited in claim 12, further comprising an over-temperature shutoff switch for said fuel control.

17. The apparatus as recited in claim 12, further comprising an over-pressure shutoff switch for said fuel control.

18. The apparatus as recited in claim 12, further comprising a water low-pressure shutoff switch for said fuel control.

19. The apparatus as recited in claim 12, further comprising a water low-flow shutoff switch for said fuel control.

20. The apparatus as recited in claim 12, further comprising a flame control shutoff switch for said fuel control.

* * * * *